United States Patent [19]

Hoffmann

[11] 4,382,755

[45] May 10, 1983

[54] DRIVESHAFT ARRANGEMENT FOR TROCHOIDAL ROTARY DEVICE

[75] Inventor: Ralph M. Hoffmann, Eden Prairie, Minn.

[73] Assignee: Trochoid Power Corporation, Eden Prairie, Minn.

[21] Appl. No.: 254,760

[22] Filed: Dec. 11, 1981

Related U.S. Application Data

[63] Continuation-in-part of Ser. No. 146,658, May 5, 1980, abandoned.

[51] Int. Cl.[3] ..... F01C 1/22

[52] U.S. Cl. ..... 418/61 A

[58] Field of Search ..... 418/61 A; 123/242

[56] References Cited

U.S. PATENT DOCUMENTS

| | | | |
|---|---|---|---|
| 3,125,996 | 3/1964 | Hoschele | 418/61 A |
| 3,208,666 | 9/1965 | Fezer et al. | 418/61 A |
| 3,213,714 | 10/1965 | Hejj et al. | 418/61 A |
| 3,253,580 | 5/1966 | Eberhard et al. | 418/61 A |
| 3,255,736 | 6/1966 | Gassmann et al. | 418/61 A |
| 3,260,135 | 7/1966 | Eisenhardt | 418/61 A |
| 3,268,156 | 8/1966 | Radziwill et al. | 418/61 A |
| 3,295,754 | 1/1967 | Abermeth et al. | 418/61 A |
| 3,875,905 | 4/1975 | Duquette | 418/61 A |

FOREIGN PATENT DOCUMENTS

| | | | |
|---|---|---|---|
| 1230261 | 12/1966 | Fed. Rep. of Germany | 418/61 A |
| 1451777 | 6/1969 | Fed. Rep. of Germany | 418/61 A |
| 974436 | 11/1964 | United Kingdom | 418/61 A |
| 994432 | 6/1965 | United Kingdom | 418/61 A |

*Primary Examiner*—John J. Vrablik

*Attorney, Agent, or Firm*—Hill, Van Santen, Steadman, Chiara & Simpson

[57] ABSTRACT

An improved rotary device having means facilitating an increased power shaft diameter. This means includes a pair of gear elements which are not related to the eccentricity of the device or to each other in the conventional manner known in the prior art. To compensate for these discrepancies in such relationships, additional gear rotational means is needed to control the rotation and revolution of the altered gear structure to compensate for the failure to maintain the heretofore required relationships with the eccentricity and with each other. One embodiment of the invention utilizes a plurality of movement control discs to accomplish this gear compensating motion, while a second embodiment utilizes a plurality of compensating gears.

5 Claims, 8 Drawing Figures

RD1
PD1
d
e
2
2

DRIVESHAFT ARRANGEMENT FOR TROCHOIDAL ROTARY DEVICE

RELATED APPLICATION

This application is a continuation-in-part application of my application Ser. No. 146,658, filed May 5, 1980, and entitled "Rotary Device", now abandoned.

BACKGROUND OF THE INVENTION

This invention relates generally to a rotary device or unit, and more particularly, to an improved rotary device having means facilitating an increased power shaft diameter.

Rotary expansion engines or power units of the type having a housing defining an epitrochoidal cavity, a planetating rotor element movable within such cavity and an eccentric or lobe means integrally formed with the power shaft on which the rotor rotates are well known in the art. It is also well known that the expansion force in these rotary expansion devices can be provided either by pressured expansion fluid or by internal combustion means and that certain of these expansion devices, particularly the devices utilizing pressurized expansion fluid, can also function equally well as a compression device, such as an air compressor. Thus, although the description of the present invention is directed primarily to a rotary expansion device utilizing pressurized expansion fluid, it is understood that the inventive principles apply to rotary expansion devices utilizing internal combustion means and rotary compression devices as well. In the conventional rotary device, the rotation of the rotor about the eccentric or lobe portion and the revolution of the radial center of the rotor about the center line of the power shaft are controlled by what are known in the art as phasing gears. These phasing gears include an internal ring gear formed within, and rotatable with, a portion of the rotor and an external pinion or stationary gear fixed with respect to the device housing. As a result of engagement between the ring and pinion gears, the rotor is caused to rotate about the eccentric or lobe portion during its revolution about the axis of the power shaft. The relationship between the ring and pinion gears is such as to insure continuous contact between each of the apices of the rotor element and the inner wall of the epitrochoidal cavity. These rotary engines or power units also include appropriate seals and valving means for selectively directing expansion fluid, in the case of a rotary expansion device utilizing this type of expansion force into the plurality of expansion chambers defined by the engine housing and the outer surfaces of the rotor. A typical rotary expansion unit of this type is described in Hoffmann U.S. Pat. No. 4,047,856.

Rotary devices or units have several design variables. One such variable is the number of lobes in the epitrochoidal cavity, and thus the number of apices on the rotor. A rotary device or unit of common construction is one having an epitrochoidal cavity with two opposing lobes and a planetating rotor with three apices. This is the type of unit described and illustrated in U.S. Pat. No. 4,047,856. In rotary expansion engines of this type, it is axiomatic that the ratio between the internal ring gear in the rotor and the external stationary or pinion gear fixed to the housing must be 3:2. In other words, the pitch diameter of the ring gear must be one and one half times greater than the pitch diameter of the pinion gear. Accordingly, the internal ring gear has one and one half times as many teeth as the external pinion gear. A further relationship necessary in this type of unit is that the pitch diameter of the internal ring gear must be exactly six times the rotor eccentricity, which is the distance between the axial center line of the power shaft and the axial center line of the rotor, and the pitch diameter of the pinion gear must be exactly four times this same eccentricity. Thus, the sizes of the ring gear and pinion gear for a given eccentricity are specified and thus limited. Because one end of the power shaft must pass through the center of this pinion gear, the diameter of such shaft is also necessarily limited. Clearly, it can be no greater than the pitch diameter of the pinion gear less the necessary radial material needed to support the gear teeth. In a conventional rotary unit as described above having a two lobe epitrochoidal cavity, the pitch diameter of the pinion gear is four times the eccentricity. In a rotary device characterized by an "inner envelope" shaped rotor, an epitrochoidal cavity having M lobes will have a rotor with $M+1$ faces or apices. In the specific case of Hoffmann U.S. Pat. No. 4,047,856, $M=2$, thus $M+1=3$. It thus follows that in the general case, the fixed pinion gear in an "inner envelope" shaped rotor will always be related to the ring gear in the ratio of $M/(M+1)$ with respect to the tooth ratio and the pitch diameters.

The limitation of power shaft diameter resulting from the heretofore necessary relationship between the pitch diameters of the ring and pinion gears and the eccentricity leads to several disadvantages or limitations of conventional rotary units. First, the power shaft is limited to how much torque it can carry. Secondly, the power shaft is known to bend due to the radial forces imposed on the rotor, thus imposing undesirable vibrations on the mechanism. Thirdly, the bending of the power shaft as mentioned above sometimes causes the pinion gear to break and may cause wear in the pinion gear bearing of a "bell mouth" pattern. Fourthly, the conventional power shaft results in a journal bearing which may be of inadequate area to carry the load imposed by the rotor.

Because of the above limitations, there is a need in the art for a rotary expansion or compression device capable of facilitating a power shaft with an increased diameter which has heretofore been limited because of design constraints dictated by the relationships between ring and pinion gear pitch diameters and rotor eccentricity.

SUMMARY OF THE INVENTION

In a first embodiment or concept, the rotary device or unit of the present invention allows for what is known in the art as the pinion or stationary gear to be increased in diameter significantly without affecting the operability of such unit, thus removing entirely the previously accepted requirement in a rotary unit having two epitrochoidal lobes that the pitch diameter of the pinion gear be four times the rotor eccentricity. In this first embodiment, the rotary unit still contemplates a ring gear-pinion gear pitch diameter ratio of 3:2, but eliminates the necessity for the pitch diameter of the pinion gear to be four times the rotor eccentricity and thus also eliminates the necessity for the pitch diameter of the ring gear to be six times the rotor eccentricity. This is accomplished by mounting this enlarged pinion gear on its own eccentricity and appropriately planetating it about the power shaft axis. The rotor size, however, is still specified and limited by the rotor eccentricity e and the parameter R (where R/e=K which together mathematically specify the size and shape of the rotor and the epitrochoidal bore. Thus, in a system incorporating this first embodiment, the ring gear which may be fit into the limiting profile of the rotor, and thus the pinion gear, is limited in part by the permissible size of the rotor.

A second embodiment or concept of the present invention enables a still larger possible power shaft for the same rotor size or profile. In this second embodiment, the 3:2 relationship between the ring gear and pinion gear pitch diameter in a rotary power unit with two epitrochoidal lobes is no longer necessary. For example, the pinion gear in this second embodiment is increased further without any corresponding increase in the ring gear diameter. With this increase in pinion gear size relative to the ring gear, however, the effect is for the rotor to rotate slower than it should. Thus, means must be provided to speed up or compensate for this insufficient rotational speed of the rotor. This correcting rotation is accomplished by a second ring and pinion gear assembly operatively connected with the enlarged first ring and pinion gear assembly.

The ability to enlarge the pinion gear, and thus increase the power shaft diameter, as described above allows for a structure with several advantages not found in conventional rotary power units. First, the increased power shaft diameter results in significant increase in its maximum torsional strength, with increases of at least two times for K factors of 7.5 and increases of at least ten times for K factors of 11. Secondly, this ability to increase the pinion gear diameter allows for multiple rotor engines to be built for larger horse powers without having to split the ring gear as shown in U.S. Pat. No. 3,062,435, since the diameter of the shaft where it passes through the pinion gear can now be larger than adjacent portions of the main power take-off shaft. Thirdly, the larger and more rigid power shaft will not bend as much, and thus not adversely affect its main bearings such as to wear the pinion gear bearing in a "bell mouth" pattern as suggested in U.S. Pat. No. 3,881,847. Fourthly, an increase in the power shaft diameter will reduce the radial pressure on the bearings and thus increase the bearing life.

The summary of the invention as described above and the description of the preferred embodiments as described below is directed primarily to a rotary power unit having an epitrochoidal cavity with two lobes and a planetating rotor with three apices. It is contemplated, however, that the concepts of the present invention are equally applicable to epitrochoidal cavities with K number of lobes and planetating rotors with K+1 apices, in the case of "inner envelope" rotors; thus, the scope of the present invention is intended to cover these. It is also contemplated that the benefits and advantages of the present invention can be realized for rotary devices characterized as epitrochoids with "outer envelopes" in which the rotor is an epitrochoid and the housing is an outer envelope of the epitrochoid. In such a configuration most elements are reversed insofar as the epitrochoidal rotor carries a pinion gear, not a ring gear, and the meshing gear is a ring gear, not a pinion gear, fastened to the stationary housing. It is also likely that all seals, both apex, arcuate, and face, would be mounted in the stationary housing rather than the moving rotor.

Accordingly, an object of the present invention is to provide a rotary device having means facilitating an increased crankshaft diameter.

Another object of the present invention is to provide a rotary device having means for increasing the pitch diameter of both the pinion and ring gears without affecting the size or operating characteristics of such device or rotor profile, thereby facilitating an increased crankshaft diameter.

Another object of the present invention is to provide in a rotary device a means for still further increasing the pitch diameter of the pinion gear, and thus facilitating a further increase in power shaft diameter, of a rotary expansion or compression device, by eliminating the need for the heretofore required ring gear-pinion gear pitch diameter ratio.

These and other objects of the present invention will become apparent with reference to the drawings, the description of the preferred embodiment and the appended claims.

DESCRIPTION OF THE PREFERRED EMBODIMENTS

Figure 1:
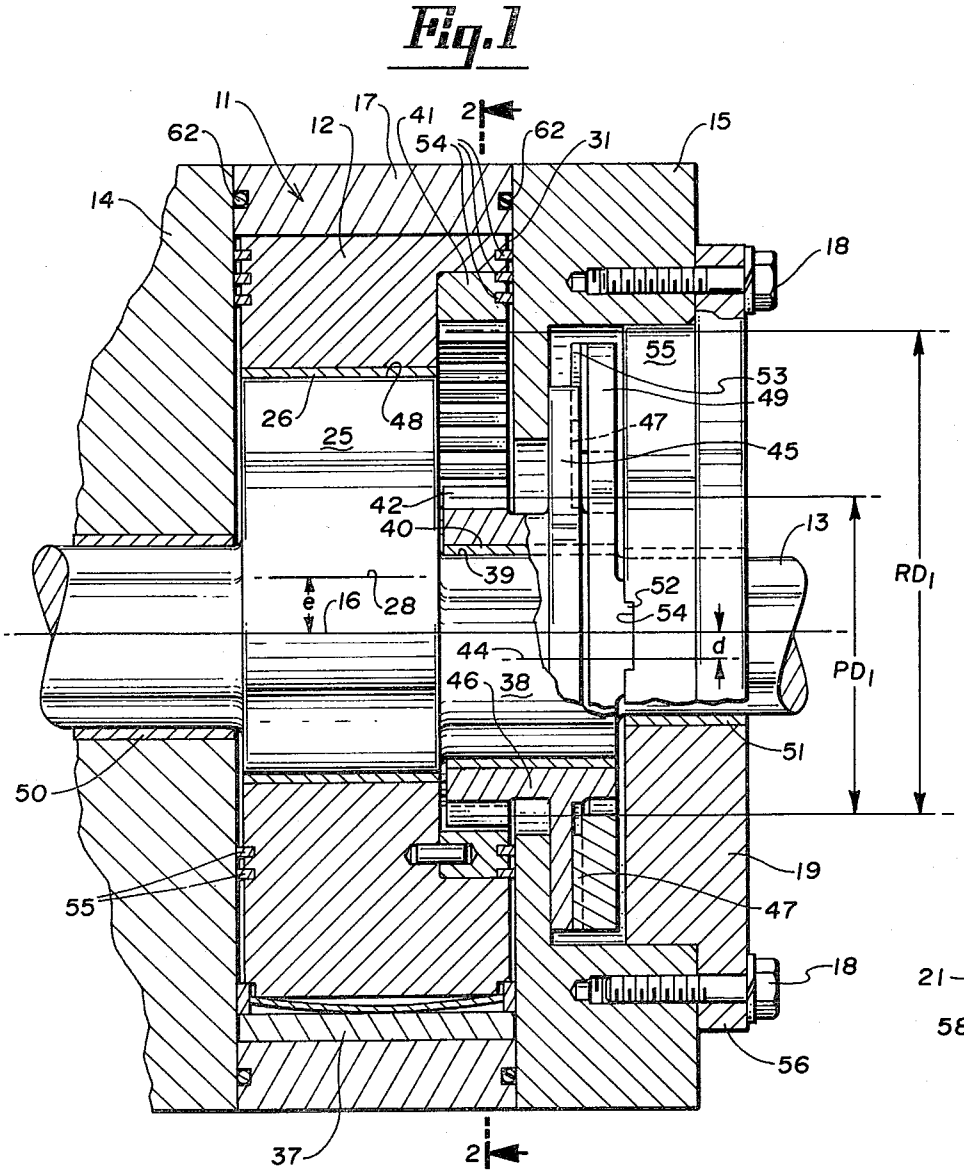
FIG. 1 is a sectional view showing a first embodiment of the improved rotary unit of the present invention.
Figure 2:
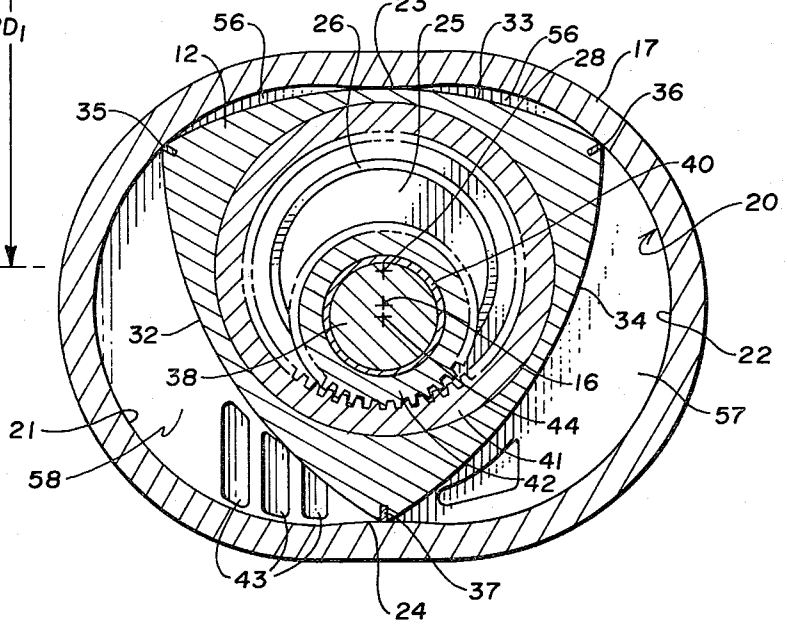
FIG. 2 is a sectional view of the embodiment of FIG. 1 as viewed along the section line 2—2 of FIG. 1.
Figure 3:
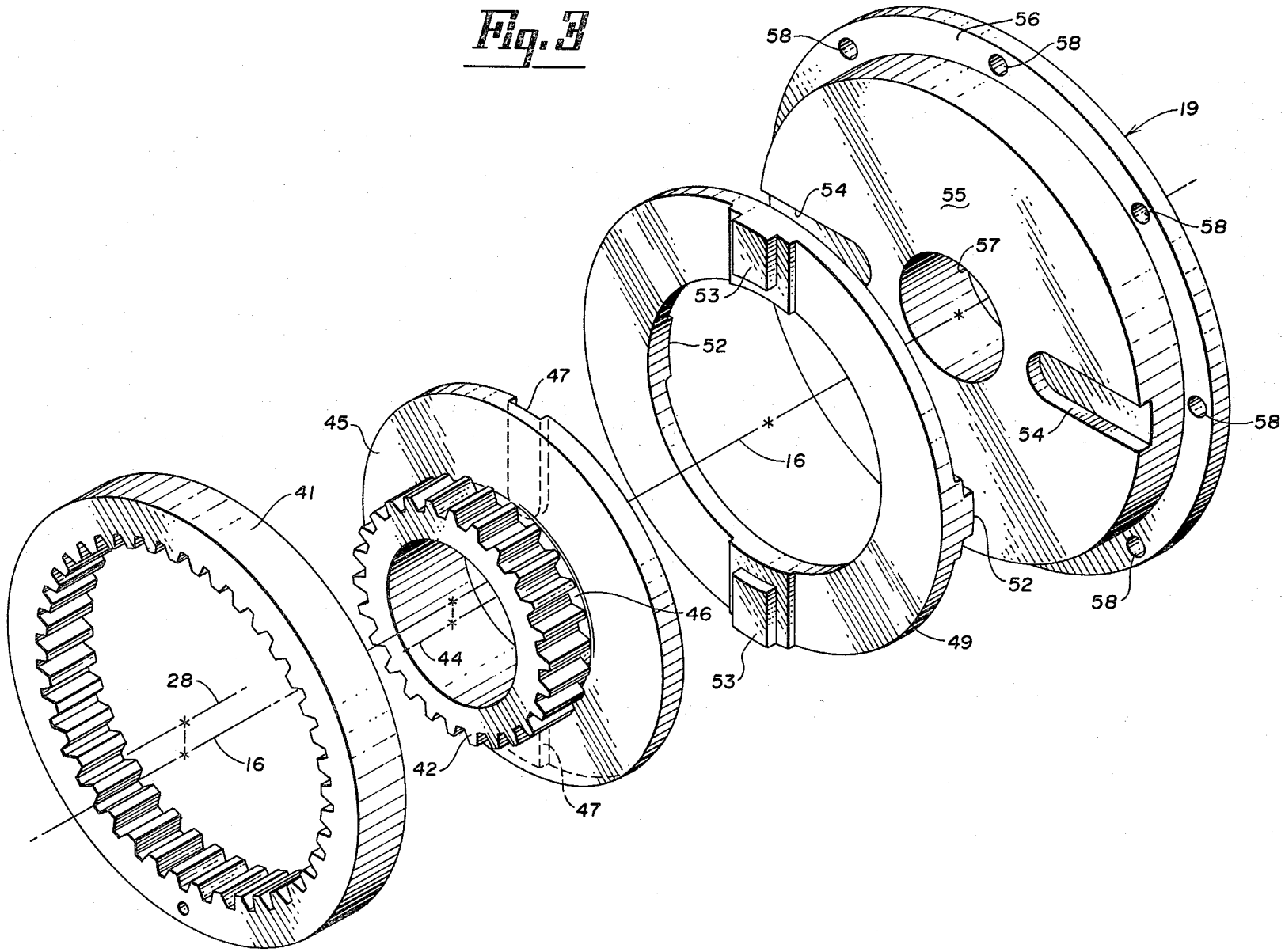
FIG. 3 is a pictorial, broken apart view showing the ring and pinion gear assembly and associated gear rotational means structure of the embodiment of FIGS. 1 and 2.
Figure 4:
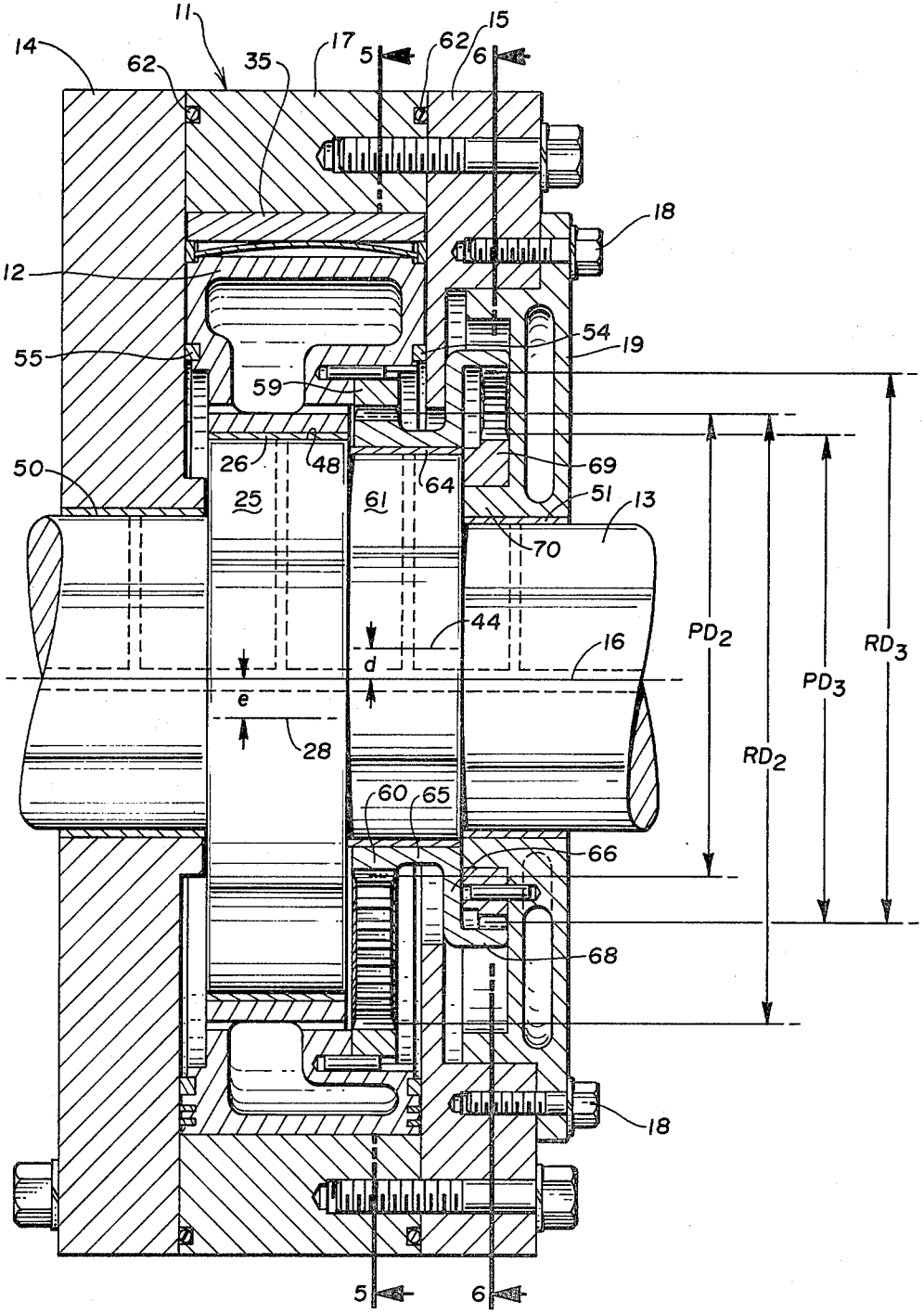
FIG. 4 is a sectional view showing a second embodiment of the improved rotary unit of the present invention.
Figure 5:
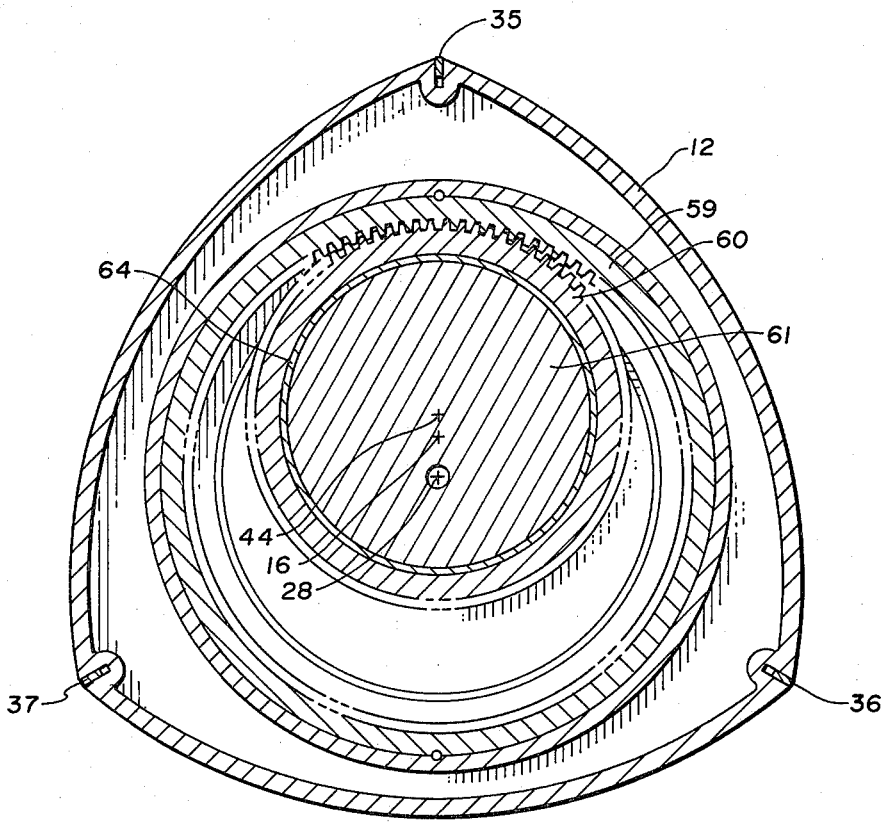
FIG. 5 is a sectional view of the embodiment of FIG. 4 as viewed along the section line 5—5 of FIG. 4.
Figure 6:
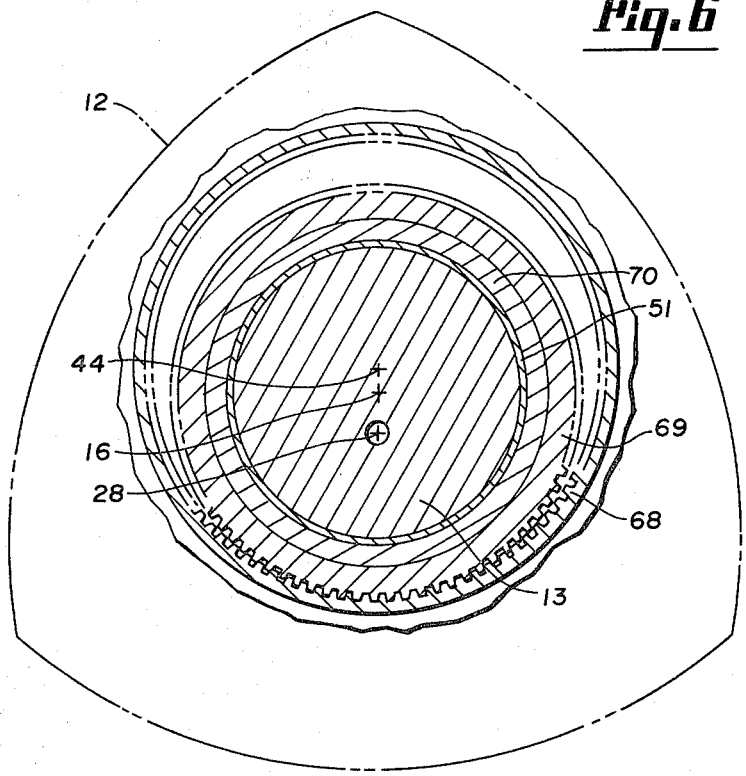
FIG. 6 is a further sectional view of the embodiment of FIG. 4 as viewed along the section line 6—6 of FIG. 4.
Figure 7:
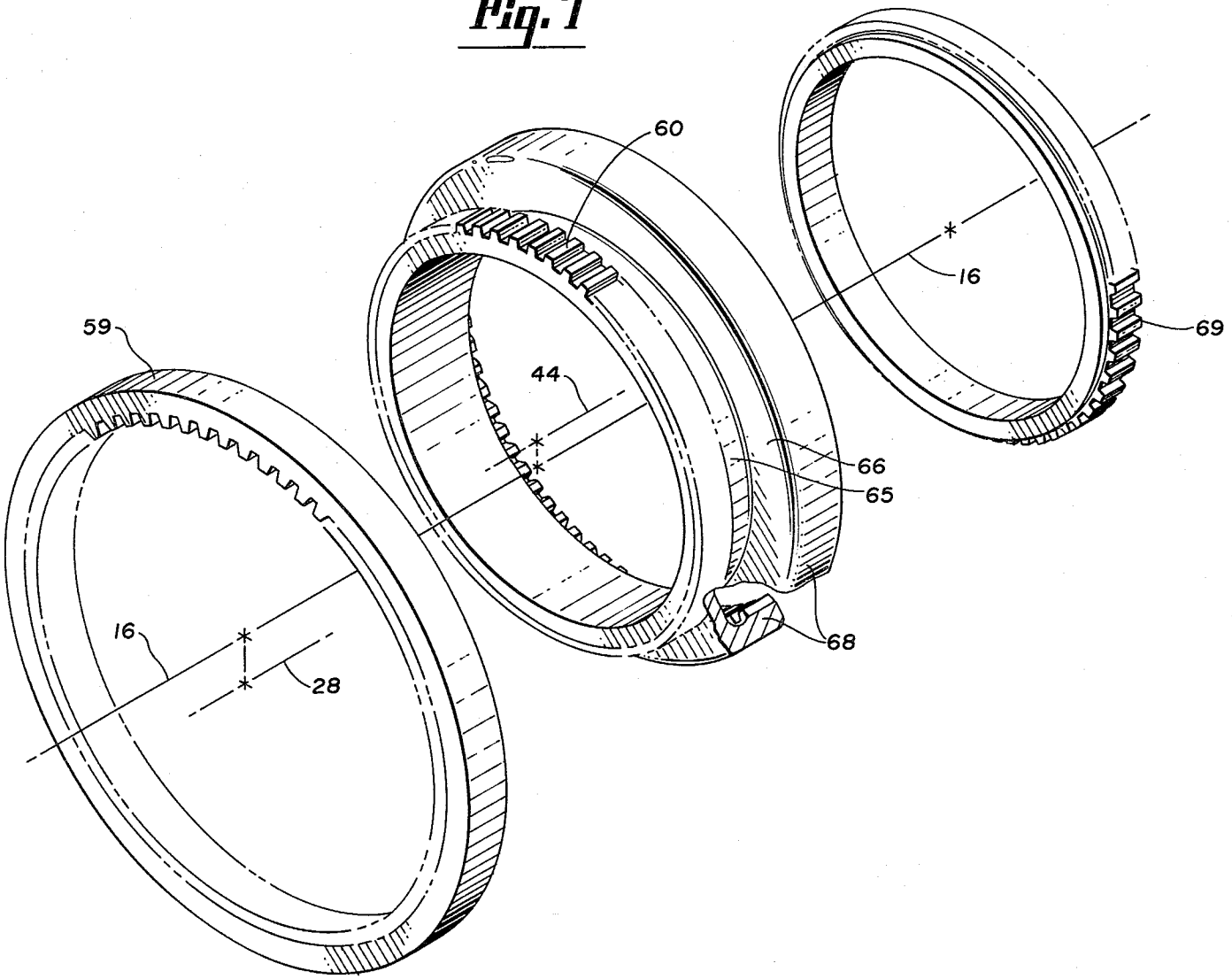
FIG. 7 is a pictorial, broken apart view showing the ring and pinion gear assembly and associated gear rotational means structure of the embodiment of FIGS. 4, 5 and 6.

FIGS. 1, 2 and 3 show a first embodiment of a rotary device of the present invention, while FIGS. 4, 5, 6 and 7 illustrate a second embodiment of a rotary device. The first embodiment shows a rotary expansion power unit having an epitrochoidal cavity with two lobes in which the conventional 3:2 ratio between the pitch diameters of the ring and pinion gears is maintained, but the conventional 6:1 and 4:1 ratios of ring gear pitch diameter to rotor eccentricity and pinion gear pitch diameter to rotor eccentricity, respectively, is altered. The second embodiment shows a rotary expansion power unit having an epitrochoidal cavity with two lobes in which neither the 3:2 ratio of ring gear pitch diameter to pinion gear pitch diameter nor the 6:1 and 4:1 ratios of ring gear pitch diameter to rotor eccentricity and pinion gear pitch diameter to rotor eccentricity are maintained.

With reference to FIGS. 1 and 2, the rotary device of the present invention comprises a housing identified by the general reference numeral 11, a rotor 12 and a crankshaft or power shaft 13. The housing 11 includes a pair of opposite end walls 14 and 15 which are axially spaced from each other along the center axis 16 of the power shaft 13. The housing 11 also includes a peripheral wall 17 positioned between the sidewalls 14 and 15 at their outer edges to define an epitrochoidal cavity 20 which is symmetrical with respect to the axis 16. As illustrated best in FIG. 2, the cavity 20 includes a pair of epitrochoidal lobes 21 and 22 which intersect at a pair of lobe junctions 23 and 24 to define the minor axis of the housing. A pair of "o" rings 62, 62 (FIG. 1) or other sealing means such as a gasket are disposed between the housing sidewalls 14 and 15 and the edges of the peripheral wall 17 to seal the cavity 20. The power shaft 13 is rotatably mounted at one end in the bearing insert or housing end plate 19 which in turn is secured to the sidewall 15 by a plurality of bolts 18 or other appropriate connecting means. A bearing sleeve 51 is disposed between the rotating power shaft 13 and the stationary housing end plate 19. The other end of the power shaft 13 is rotatably mounted with respect to a portion of the sidewall 14 by the sleeve bearing 50.

The power shaft 13 includes a first eccentric member or lobe 25 having a generally cylindrical outer surface 48. The lobe 25 is circular in transverse section and is concentric about a second axis 28 parallel to and spaced from the center crankshaft axis 16 by the distance "e". In the art, this distance "e" is referred to as the eccentricity of the rotor. The rotor 12 is rotatably mounted relative to the outer cylindrical surface 48 via the annular sleeve bearing 26. The rotor 12 is symmetrical about the axis 28 of the eccentric lobe 25; hence, the rotor 12 and the eccentric lobe 25 are concentric with their center axis being radially displaced from the center axis 16 of the power shaft 13 by the eccentricity "e".

The rotor 12 includes a pair of opposite outer sidewall surfaces 30 and 31 which are adjacent and in slightly spaced relation to the inner surfaces of the housing sidewalls 14 and 15, respectively. The sidewall surfaces 30 and 31 are connected by a plurality of smooth epitrochoidal flank surfaces 32, 33 and 34 which intersect at apices 35, 36 and 37 (FIG. 2). The apices 35, 36 and 37 define a plurality of fluid expansion (or compression as the case may be) chambers 56, 57 and 58 (FIG. 2). An interior cylindrical surface of the rotor supports the sleeve bearing member 26 for rotational connection with the outer cylindrical surface 48 of the eccentric lobe 25.

As illustrated best in FIG. 1, the side surfaces 30 and 31 of the rotor provide a supporting surface for the plurality of seal members 55 and 54, respectively. These seal members 55 and 54, together with the apices 35, 36 and 37 define a plurality of expansion fluid cavities for the introduction of expansion fluid into the various expansion chambers of the power unit as fully understood in the prior art and as particularly shown in U.S. Pat. No. 4,047,856. The housing is provided with appropriate steam or expansion fluid passages to provide expansion fluid to the expansion cavities or chambers 56, 57 and 58. The rotary power unit also includes appropriate valving means to direct the expansion fluid from the passages into the expansion fluid chambers 56, 57 and 58 in a manner conventional in the art.

In conventional prior art rotary expansion power units such as the one illustrated in U.S. Pat. No. 4,047,856, a pair of phasing gears are provided to properly position the rotor 12 within the epitrochoidal cavity 20 during rotation of the power shaft 13. These prior art phasing gears, one of which is an internal ring gear connected with the planetating rotor and the other of which is an external pinion or stationary gear connected with an end wall of the housing, function to insure that the apices 35, 36 and 37 (FIG. 2) of the rotor are in contact with a portion of the surface of the epitrochoidal cavity 20 at all times during operation of the unit. To maintain such contact, these phasing gears must have a specific relationship to one another and a specific relationship to the eccentricity of the rotor. This relationship which is accepted in the prior art for an epitrochoidal cavity with two lobes and a rotor with three apices requires the pitch diameter of the internal ring gear to be six times the eccentricity "e" of the rotor and the pitch diameter of the pinion or stationary gear to be four times the rotor eccentricity "e". Because of the above necessary relationship, the ratio of the pitch diameter of the ring gear to the pitch diameter of the pinion or stationary gear must be 3:2. In other words, the ring gear pitch diameter must be one and one half times larger than the pinion gear pitch diameter and must include one and one half times as many gear teeth. Because the power shaft of rotary expansion power units must pass through the inside of the pinion gear, these prior art rotary units are limited to having a power shaft with a diameter less than the pitch diameter of the pinion gear. As set forth in the Background of Invention section, this limitation on the diameter of the power shaft leads to several limitations and disadvantages with regard to prior rotary power units. With the structure of the present invention, the pitch diameter of the pinion gear can be significantly increased without regard to the 3:2 ring gear-pinion gear ratio and without regard to the 6:1 and 4:1 ratios of the ring gear to eccentricity and pinion gear to eccentricity. Because of this permitted increase in pinion gear diameter, the power shaft diameter can also be increased.

One embodiment of the ring and pinion gear assembly to permit such enlargement of the pinion gear is illustrated in FIGS. 1–3. As shown, such embodiment includes an internal ring gear 41 with a plurality of internal gear teeth connected with the rotor 12 and an external pinion gear 42 with a plurality of external gear teeth adapted for appropriate meshing with the teeth of the ring gear 41. In this embodiment, the pitch diameter $PD_1$ of the pinion gear 42 is greater than the normally accepted four times the rotor eccentricity and the pitch diameter $RD_1$ of the ring gear 41 is greater than the normally accepted six times the rotor eccenticity "e". The ratio between the pitch diameters of the ring gear 41 and the pinion gear 42, however, is maintained at 3:2. Because the ring gear 41 and pinion gear 42 are no longer related to the eccentricity with the conventional relationship, it is necessary to compensate for this variance. Such compensation is accomplished by mounting the pinion gear 42 on its own eccentricity and appropriately planetating it about the center shaft axis 16. As illustrated, the pinion gear 42 is supported in rotational relationship with respect to a second eccentric portion or lobe 38 integrally formed with the power shaft 13. A cylindrical sleeve bearing 40 is disposed between the inner cylindrical surface of the pinion gear 42 and the outer cylindrical surface 39 of the lobe 38 to rotatably mount the gear 42. The eccentric lobe 38 has its axial center along a third axis 44 which is parallel to and spaced from the center line 16 of the power shaft 13 by the distance "d".

Mounting the enlarged pinion gear 42 eccentrically with regard to the center line 16 only partially compensates for the deviation from the necessary 6:1 and 4:1 relationships between the ring gear pitch diameter $RD_1$ and rotor eccentricity "e" and between the pinion gear pitch diameter $PD_1$ and rotor eccentricity "e". To fully compensate for this deviation, the enlarged pinion gear 42 must also be planetated on its axis 44 about axis 16. In the embodiment of FIGS. 1–3, means must be provided for causing such movement of the gear 42 about its axis 44 at the rate of one rotation per revolution. With such a structure, the gear 42 will revolve about the axis 16, but will not rotate with respect to that same axis.

As shown in FIGS. 1 and 3 and particularly in FIG. 3, the pinion gear 42 includes an enlarged mating disc 45 integrally joined via the intermediate section 46 with the portion of the gear 42 which meshes with the ring gear 41. The mating disc 45 includes a pair of female key slots 47, 47 diametrically opposed to each other about the periphery of the disc 45. These key slots 47,47 are generally rectangular recessed portions disposed near the outer periphery of the plate 45 and on the side opposite the gear 42. As shown, the slots 47, 47 are open at the outer periphery of the plate 45 and extend in a generally radial direction toward the center axis 44 of the gear 42.

An annular intermediate disc or rotational movement control means 49 is positioned adjacent to the mating disc 45 in generally face-to-face relationship. The disc 49 is generally annular in shape and includes a first pair of diametrically opposed male key portions 53,53 disposed near its outer periphery. These key portions 53,53 extend in a generally radial direction toward the center of the disc 49 and are adapted for operative engagement with the key slots 47,47 in the mating disc 45. As shown, the slots 47,47 must be long enough to accommodate the sliding movement of the key portions 53,53 therein during revolution of the gear 42 about the power shaft axis 16. Thus, the slots 47, 47 and keys 53,53 permit limited relative movement between the discs 45 and 49 in a radial direction parallel to the elements 47,47 and 53, 53 but precludes relative rotational movement between the discs 45 and 49.

The side of the intermediate disc 49 opposite the key portions 53, 53 is provided with a pair of diametrically opposed male key elements 52,52 also disposed at the periphery of the disc 49. These elements 52,52 are similar to the elements 53, 53, but are rotationally displaced therefrom by an angle of 90°. The key elements 52, 52 are adapted for engagement with a pair of female slot portions 54, 54 formed in a rotational movement control portion of the end housing 19. The slots 54,54 and the key elements 52, 52 permit limited movement between the plate 49 and the stationary end housing 19 in a radial direction parallel to the elements 52, 52 and 54, 54, but precludes relative movement between the plate 49 and end housing 19. The end housing 19 includes a generally cylindrical portion 55 in which the slots 54, 54 are disposed and a flange portion 56 with a plurality of holes 58 for connection with the main housing of the unit.

As the shaft 13 rotates, the pinion gear 42 revolves about the center 16. However, because of the engagement between the slots 47,47 and keys 53,53 and engagement between the slots 54,54 and keys 52,52, rotational movement of the pinion gear 42 with respect to the crankshaft axis 16 is prevented.

In designing and constructing the ring and pinion gear assembly of FIGS. 1–3 as described above, it can be shown that the amount of eccentricity "d" of the pinion gear 42 must always be equal to the following:

$d = r/2 - e$, where:

d = eccentricity of the pinion gear 42 r = pitch radius of the pinion gear 42 e = rotor eccentricity

As illustrated in the preferred embodiment of FIGS. 1–3, it can be seen that the eccentricity "d" of the pinion gear 42 is exactly 180° opposite the rotor eccentricity "e".

Reference is next made to FIGS. 4–7 which illustrate the second embodiment of the present invention. As discussed previously, the embodiment of FIGS. 1, 2 and 3 provides compensation means for a structure in which the ring gear and pinion gear pitch diameter ratio of 3:2 is maintained, but the 6:1 and 4:1 ratios of the ring gear pitch diameter to rotor eccentricity and pinion gear pitch diameter to rotor eccentricity is altered. According to the embodiment of FIGS. 4–7, it is possible to gain a still larger possible power shaft for the same rotor profile or outer limit by increasing still further the already enlarged pinion gear.

The general structure of the rotary device illustrated in FIGS. 4 through 7 is similar to the structure illustrated in FIGS. 1–3. Thus, similar elements are identified by the same reference numerals. The embodiment of FIGS. 4–7 includes a housing 11 having a pair of housing ends 14 and 15 and a peripheral housing section 17 connected at its edges to the inner surfaces of the housing side members 14 and 15. A pair of "o" rings 62,62 or other suitable sealing members are provided between the housing members 14, 15 and 17 to provide an effective seal. The power shaft 13 extends through the central portion of the housing and is supported for rotation within the housing by the bearing sleeve members 50 and 51. The sleeve bearing 50 is supported by the housing side member 14 while the sleeve bearing member 51 is supported by the end housing member 19. The end housing member 19 is secured to the housing side member 15 by a plurality of threaded bolts 18. The embodiment of FIGS. 4–7 further includes a rotor 12 and appropriate seal members 54 and 55 disposed between the rotor 12 and the inner surfaces of the housing side members 14 and 15. The seal members 54 and 55, together with the apex seals 35, 36 and 37, define a plurality of expansion chambers within the housing 11 in a manner conventional in the art. Appropriate means are also provided for controlling the supply of expansion fluid to such chambers in a manner conventional in the art. The rotor 12 is rotatably supported with respect to the eccentric lobe portion 25 integrally formed with the power shaft 13. The eccentric lobe 25 includes an outer cylindrical surface 48 which supports the rotor 12 in rotational relationship via the sleeve bearing member 26. As with the structure illustrated in FIGS. 1–3, the center axis 28 of the lobe 25 is displaced from the center line 16 of the power shaft 13 by the eccentricity "e".

The embodiment of FIGS. 4–7 further includes first and second gear means comprising an internal ring gear 59 having a plurality of internal gear teeth and an external pinion gear portion 60 having a plurality of external gear teeth adapted for engagement with the teeth of the internal ring gear 59. The ring gear 59 is fixed with respect to the rotor 12 and thus rotates and revolves therewith. The pinion gear portion 60, unlike the prior art structures, is rotatably mounted on a second eccentric lobe portion 61 integrally formed with the power shaft 13. A sleeve bearing 64 is provided between the outer cylindrical surface of the lobe 61 and the inner cylindrical surface of the pinion gear portion 60 to facilitate such relative rotational movement. The center line 44 of the lobe 61 and thus also the pinion gear portion 60 is offset from the power shaft centerline 16 by the distance "d". This eccentricity of the gear portion 60 compensates for the fact that the 6:1 and 4:1 ratios of ring gear 59 pitch diameter to rotate eccentricity "e" and pinion gear 60 pitch diameter to rotor eccentricity "e", respectively, is not maintained. For example, the pitch diameter $RD_2$ of the ring gear 59 is approximately fourteen times the rotor eccentricity "e" while the pitch diameter $PD_2$ of the pinion gear portion 60 is over ten times the rotor eccentricity "e".

In the embodiment of FIGS. 4–7, the pinion gear portion 60 is enlarged so that the ratio between the pitch diameters of the ring gear 59 and pinion gear portion 60 is less than 3:2. Because the 3:2 relationship no longer exists, due to the pinion gear portion 60 being larger than normal, the pinion gear portion 60 tends to rotate the ring gear 59 and rotor 12 slower than it should. Thus, it is necessary to rotate the pinion gear portion 60 slightly during each revolution of the power shaft 13 in order that the intentional "error in rotation" EIR is corrected by an appropriate rotation in the opposite direction. In the preferred embodiment of FIGS. 4–7, this correcting rotation is accomplished by third and fourth correcting gear means comprising the internal ring gear portion 68 with a plurality of internal gear teeth and the external pinion gear 69 with a plurality of external gear teeth.

As mentioned above, the pitch diameter $RD_2$ of the ring gear 59 is approximately fourteen times the rotor eccentricity "e" and the pitch diameter $PD_2$ of the pinion gear 60 is over ten times the rotor eccentricity "e". With these dimensions neither the 3:2 relationship between the pitch diameters $RD_2$ and $PD_2$ nor the 6:1 and 4:1 ratios between the ring gear pitch diameter $RD_2$ and rotor eccentricity and pinion gear pitch diameter $PD_2$ and rotor eccentricity are maintained. To compensate for these alterations, the pinion gear 60 must be mounted on an eccentric relative to the center line 16 of the power shaft 13 as described above. In addition, unlike the structure of FIGS. 1–3 in which it was necessary only to prevent the pinion gear from rotating as it revolved about the power shaft axis 16, the structure of FIGS. 4–7 requires that a certain relative rotation be imparted to the pinion gear 60 during its revolution about the axis 16. This rotation is necessary to compensate for the tendency of the larger pinion gear 60 to cause the ring gear 59, and thus the rotor 12, to move slower than it should.

To accomplish this correcting rotation, the pinion gear portion 60 is integrally joined with the ring gear portion 68 via the intermediate sections 65 and 66. This ring gear portion 68 is concentric with respect to the pinion gear portion 60 and is centered about the axis 44. The gear portion 68 includes a plurality of internal teeth adapted for meshing engagement with the external teeth of the pinion or stationary gear 69. The gear 69 is mounted in a fixed position within a portion of the end housing 19 by appropriate means. By varying the size relationship between the pitch diameters $RD_3$ and $PD_3$ of the ring gear portion 68 and the pinion or stationary gear 69, the amount which the ring gear 68, and thus the internal pinion gear 60, rotates during each revolution of the power shaft 13 can be controlled.

The following formula is used to calculate the pitch diameters $RD_3$ and $PD_3$ of the ring gear 68 and pinion gear 69, respectively:

$$C = \frac{(B - A + 2e)\,3B}{2A - 3B}$$

and

D=C-2d, where:

A=pitch diameter $RD_2$ of the ring gear 59

B=pitch diameter $PD_2$ of the pinion gear 60

C=pitch diameter $RD_3$ of the ring gear 68

D=pitch diameter $PD_3$ of the pinion gear 69 e=rotor eccentricity d=eccentricity of pinion gear 60 and ring gear 68 or $$d = \frac{A - B - 2e}{2}$$

In all cases involving epitrochoids with inner envelopes, the pitch diameters must satisfy the following equation:

$$\frac{A}{B} \times \frac{C}{D} = \frac{Z}{Z - 1}$$

Where: Z=the number of segments of the inner envelope.

Thus, in the specific case of a structure having an epitrochoidal cavity with two lobes and an inner envelope rotor with three segments or apices, Z=3, and thus the following formula applies:

$$\frac{A}{B} \times \frac{C}{D} = \frac{3}{2}$$

d=eccentricity of pinion gear 60 and ring gear 68

For purposes of illustration, the eccentricity d of the second eccentric lobe 61 is 180° opposite the rotor eccentricity e in FIGS. 4–7. However, it is also within the contemplation of the present invention to set the second eccentric d at any angle less than 180° with respect to the rotor eccentric e. If the angular spacing between the eccentrics is 180°, then values for $RD_3$ and $PD_3$ leave little room for choice, which can result in undesirably large pitch diameters for the correction gears 68 and 69. If, on the other hand, the angular spacing is less than 180°, more choices become available for the correcting gear pitch diameters and there is a better likelihood that practical gear diameters can be found for 68 and 69.

Figure 8:
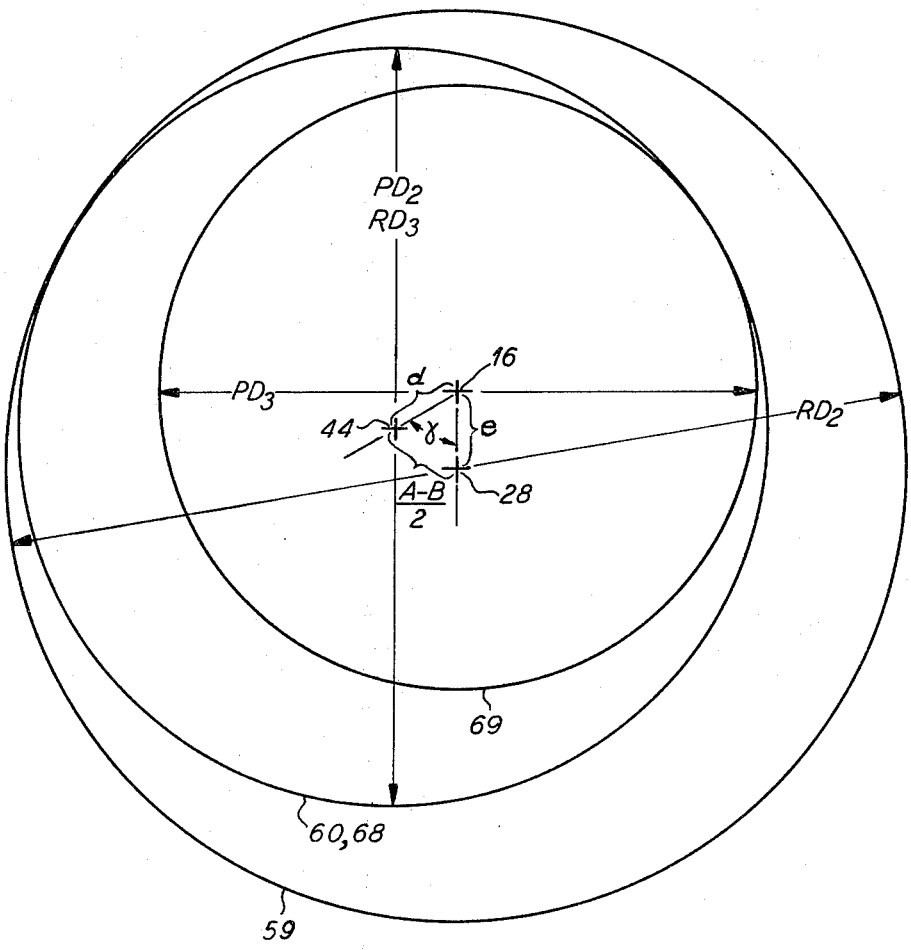
FIG. 8 is a schematic diagram showing the manner by which correcting gears are determined for the second embodiment of the present invention.

For example, FIG. 8 illustrates a determination of the pitch diameters for inner envelope devices correcting gears 68 and 69 when the angular spacing $\gamma$ between the rotor eccentric e and the secondary eccentric d is less than 180°. Let e=½" and Z=3, such that the epitrochoidal cavity has two lobes and the inner envelope profile of the rotor has three apices. Conventionally, the gear ratio for the normal phasing gears would be 3:2; however, in accordance with the present invention, let $RD_2$=6" and $PD_2$=5", for a ratio of 6÷5=1.2 rather than 1.5. The following procedure is used to calculate the pitch diameters $RD_3$ and $PD_3$ of gears 68 and 69, where:

A=6=pitch diameter of the gear coaxial with the envelope profile=pitch diameter $RD_2$ of ring gear 59

B=5=pitch diameter of secondary eccentric gear engaging with gear A=pitch diameter $PD_2$ of pinion gear 60

C=pitch diameter of secondary eccentric gear engaging with gear D=pitch diameter $RD_3$ of ring gear 68

D=pitch diameter of the gear coaxial with the trochoidal profile=pitch diameter $PD_3$ of pinion gear 69

EIR=error in rotation of the gear coaxial with the trochoid envelope profile, 59

Z=3=a non-dimensional parameter corresponding to the number of envelope apices e=½=rotary eccentricity d=eccentricity of the secondary eccentric, 61

The following formulas apply:

If EIR is greater than 0 (gear A is a ring gear and gear B is an external pinion) then A−B=2d. If EIR is less than 0 (gear A is an external pinion and gear B is a ring gear) then B−A=2d $$EIR = \frac{D-C}{D} - \frac{1}{1-Z} \text{ per shaft revolution and}$$

$$\frac{B-A}{B} = \frac{-D}{C} \times EIR$$

For this example, EIR is greater than 0 and the value D/C is 0.8. Depending on the wishes of the designer and the minimum acceptable dimensions allowing the necessary meshing of the ring and pinion correction gears given a particular tooth pitch value, any values may be selected for D and C satisfying the D/C ratio determined above. As illustrated in FIG. 8, values D=4″ and C=5″ have been selected for gears. Further solving, d=½″ and, using the law of cosines, $\gamma=30°$.

Figure 9:
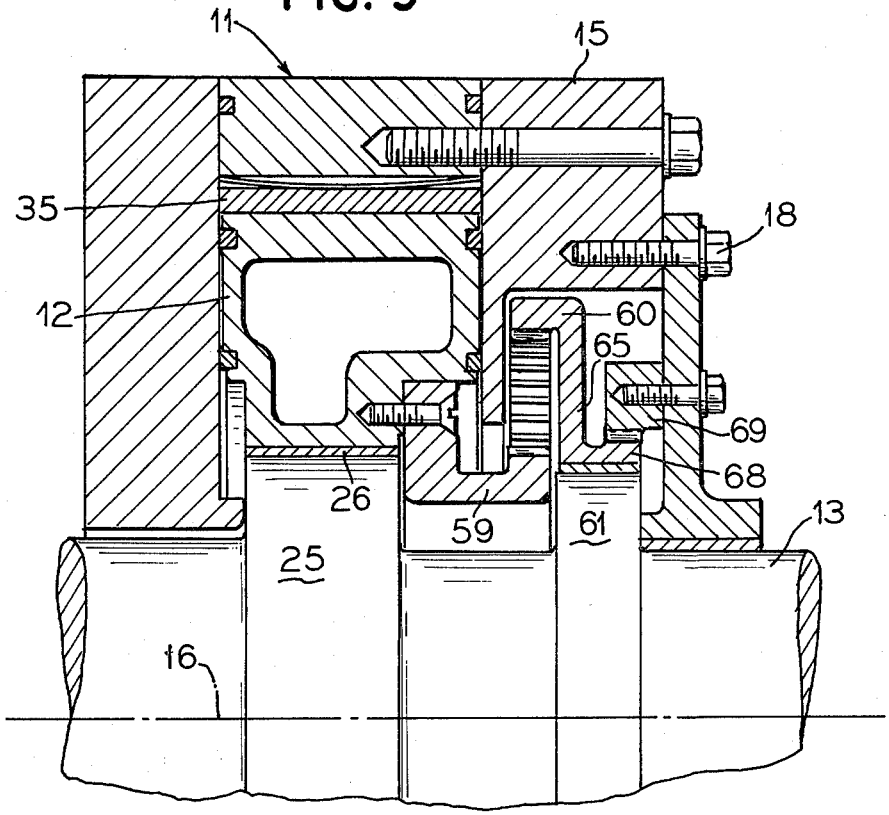
FIG. 9 is a sectional view of an outer envelope type rotary unit constructed in accordance with the second embodiment of the invention.

This approach for varying the conventional ratio of the phasing gears to permit enlargement of the crankshaft and for providing a secondary eccentric and corrective gears is the same in the case of other inner envelope trochoidal devices, such as hypotrochoids. The approach is also the same in the case of outer envelope trochoidal devices; however, as those skilled in the art will appreciate, the sequence of timing gears is the reverse of the sequence described above in connection with an inner envelope device. This is illustrated in FIG. 9 which shows an outer envelope epitrochoidal device based on the epitrochoid used to generate the profiles of the working members in the device of FIGS. 4–7. FIG. 9 shows the inventive rotor movement control arrangement whereby the sequence of timing gears is the reverse of the sequence used in the inner envelope device.

Although various minor modifications may be suggested by those versed in the art, it should be understood that I wish to embody within the scope of the patent warranted hereon all such modifications as reasonably and properly come within the scope of my contribution to the art.

I claim as my invention:

1. In an inner envelope trochoidal rotary device having a housing defining a trochoidal cavity symmetrical about a first axis, a shaft disposed in said housing for rotation about said first axis, a rotor eccentric connected to said shaft having a second axis parallel to said first axis and spaced therefrom by a distance e, a rotor symmetric about said second axis and disposed on said rotor eccentric for planetating movement in said cavity as said shaft rotates, and a gear ring of pitch diameter A coaxial with said rotor and connected thereto, apparatus cooperating with said gear ring to control movement of said rotor relative to said shaft and enable the diameter of said shaft to be adequately sized to handle torque loads imposed thereon, comprising: a further eccentric connected to said shaft having a third axis parallel to said first axis and spaced therefrom by a distance d, said third axis being 180° from said second axis relative to said first axis and the diameter of said further eccentric being different from that of said rotor eccentric, a gear wheel supported for rotation on said further eccentric having adjacent first and second gears of respective pitch diameters B and C concentric about said third axis, said first gear engaging said gear ring, and a fixed final gear of a pitch diameter D disposed about said shaft concentric with said first axis for engaging said second gear, wherein said values e, d, A, B, C, and D are defined by:

$$d = \frac{A-B-2e}{2}$$

$$D = C - 2d, \text{ and}$$

$$C = \frac{(B-A+2e)\times 3B}{2A-3B}.$$

2. The apparatus of claim 1, wherein said cavity is of an epitrochoidal profile having two lobes.

3. In an inner envelope trochoidal rotary device having a housing defining a trochoidal cavity symmetrical about a first axis, a shaft disposed in said housing for rotation about said first axis, a rotor eccentric connected to said shaft having a second axis parallel to said first axis and spaced therefrom by a distance e, a rotor having envelope profile apices amounting to a number Z symmetric about said second axis and disposed on said rotor eccentric for planetating movement in said cavity as said shaft rotates, and a gear ring of pitch diameter A coaxial with said rotor and connected thereto, apparatus cooperating with said gear ring to control movement of said rotor relative to said shaft and enable the diameter of said shaft to be adequately sized to handle torque loads imposed thereon comprising: a further eccentric connected to said shaft having a third axis parallel to said first axis and spaced therefrom by a distance d, said third axis being less than 180° from said second axis relative to said first axis and the diameter of said further eccentric being different from that of said rotor eccentric, a gear wheel supported for rotation on said further eccentric having adjacent first and second gears of respective pitch diameters B and C concentric about said third axis, said first gear engaging said gear ring such that said gear ring rotates relative to said shaft slower than it should producing an error in rotation of a positive value EIR per shaft revolution, and a fixed final gear of a pitch diameter D disposed about said shaft concentric with said first axis for engaging said second gear to correct said error in rotation, wherein said values e, d, A, B, C, and D are defined by:

$$A - B = 2d$$

$$EIR = \frac{D-C}{D} - \frac{1}{1-Z}, \text{ and } \frac{B-A}{B} = \frac{-D}{C} \times EIR.$$

4. The apparatus of claim 3, wherein said cavity is of an epitrochoidal profile having two lobes.

5. In an outer envelope trochoidal rotary device having a housing defining a cavity symmetrical about a first axis, said cavity having envelope profile apices numbering Z, a shaft disposed in said housing for rotation about said first axis, a rotor eccentric connected to said shaft having a second axis parallel to said first axis and spaced therefrom by a distance e, a trochoidal shaped rotor symmetrical about said second axis and disposed on said rotor eccentric for planetating movement in said cavity as said shaft rotates, and a gear ring of pitch diameter A coaxial with said cavity and connected to said rotor, apparatus cooperating with said gear ring to control movement of said rotor relative to said rotor eccentric and enable the diameter of said shaft to be adequately sized to handle torque loads imposed thereon comprising: a further eccentric connected to said shaft having a third axis parallel to said first axis and spaced therefrom by a distance d, said third axis being less than 180° from said second axis relative to said first axis and the diameter of said further eccentric being different from that of said rotor eccentric, a gear wheel supported for rotation on said further eccentric having adjacent first and second gears of respective pitch diameters B and C concentric about said third axis, said first gear engaging said gear ring such that said gear ring rotates relative to said shaft slower than it should producing an error in rotation of a negative value EIR per shaft revolution, and a fixed final gear of a pitch diameter D disposed about said shaft concentric with said first axis for engaging said second gear, wherein said values e, d, A, B, C, and D are defined by:

$$B - A = 2d$$

$$EIR = \frac{D - C}{D} - \frac{1}{1 - Z}, \text{ and } \frac{B - A}{B} = \frac{-D}{C} \times EIR.$$

* * * * *